US010030652B1

(12) United States Patent
Sims et al.

(10) Patent No.: US 10,030,652 B1
(45) Date of Patent: Jul. 24, 2018

(54) PUMP JACK WITH DOWNHOLE PUMP

(71) Applicant: CENTURION ARTIFICIAL LIFT, Midland, TX (US)

(72) Inventors: Michael Shane Sims, Midland, TX (US); Michael Chad McNeely, Midland, TX (US)

( * ) Notice: Subject to any disclaimer, the term of this patent is extended or adjusted under 35 U.S.C. 154(b) by 0 days.

(21) Appl. No.: 15/821,412

(22) Filed: Nov. 22, 2017

Related U.S. Application Data

(60) Provisional application No. 62/490,450, filed on Apr. 26, 2017.

(51) Int. Cl.
*E21B 43/12* (2006.01)
*F04B 53/16* (2006.01)
*F04B 47/02* (2006.01)

(52) U.S. Cl.
CPC ..... *F04B 53/16* (2013.01); *E21B 43/127* (2013.01); *F04B 47/02* (2013.01)

(58) Field of Classification Search
CPC combination set(s) only.
See application file for complete search history.

(56) References Cited

U.S. PATENT DOCUMENTS 530,350 A * 12/1894 Rosenkranz ..... E21B 33/1208 277/342
2,883,246 A * 4/1959 Hatch ..... F04B 53/162 138/155
3,638,970 A * 2/1972 Sandquist ..... E21B 17/18 285/123.1
4,268,197 A * 5/1981 Burgsmuller ..... B23B 51/0486 408/59
2013/0039780 A1* 2/2013 Lane ..... F04B 47/02 417/53

* cited by examiner

*Primary Examiner* — Cathleen R Hutchins
*Assistant Examiner* — Ronald R Runyan
(74) *Attorney, Agent, or Firm* — Buskop Law Group, P.C.; Wendy Buskop

(57) ABSTRACT

A pump jack has a horse head, a sucker rod connected to the horse head, and a downhole pump connected to the sucker rod. The downhole pump has a reciprocating plunger, a multi-segment barrel, a plurality of sand couplings, and a plurality of wiper couplings.

10 Claims, 3 Drawing Sheets

PUMP JACK WITH DOWNHOLE PUMP

CROSS REFERENCE TO RELATED APPLICATIONS

The present application claims priority to and the benefit of U.S. Provisional Patent Application Ser. No. 62/490,450 filed on Apr. 26, 2017, entitled "PUMP JACK WITH DOWNHOLE PUMP". This reference is hereby incorporated in its entirety.

FIELD

The present embodiment generally relates to a pump jack with downhole pump.

BACKGROUND

A need exists for a pump jack with downhole pump that resist sand damage between the barrel and plunger assembly.

The present embodiments meet these needs.

BRIEF DESCRIPTION OF THE DRAWINGS

The detailed description will be better understood in conjunction with the accompanying drawings as follows.

Figure 1:
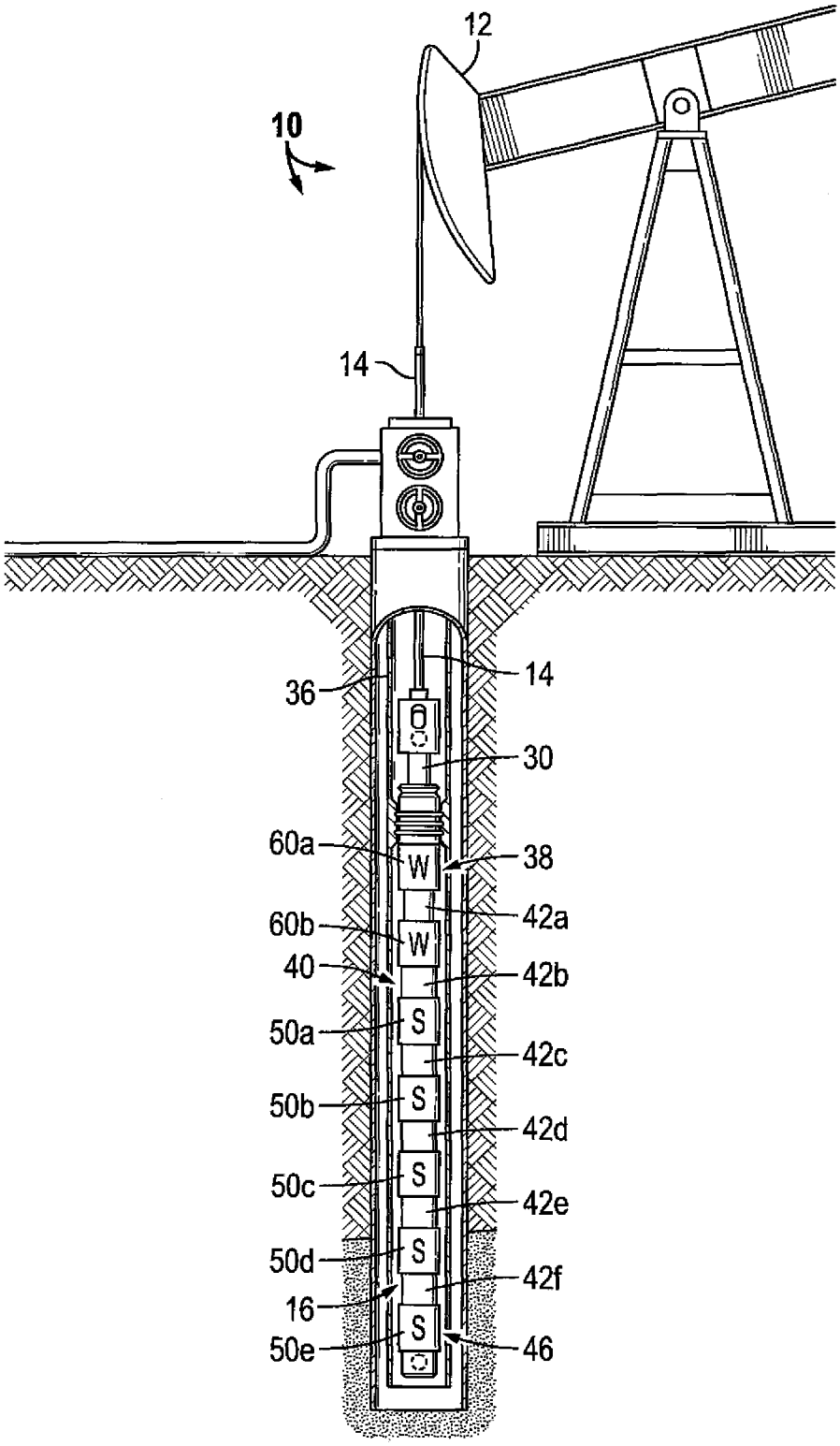
FIG. 1 depicts an overview of a pump jack connected to a downhole pump according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The invention relates to a pump jack.

A pump jack 10 having a horse head 12, a sucker rod, and a downhole pump 16. The sucker rod is connected to the horse head and the downhole pump is connected to the sucker rod.

The downhole pump is made up of a reciprocating plunger assembly, a multi-segment barrel 40, a plurality of sand couplings 50*ab*, and a plurality of wiper couplings 60*ab*.

The reciprocating plunger assembly is connected to the sucker rod 14.

The multi-segment barrel 40, has a plurality of stationary segments 42*a*-42*f* fluidly connected in series. The reciprocating plunger assembly 30 is attached to the tubing 36 and slidably engages the multi-segment barrel 40.

Each one of the plurality of sand couplings 50*ab* is connected between pairs of stationary segments. Each sand coupling has a hollow cylindrical body 52 with at least one inner groove 54. The at least one inner groove 54 has a depth from 1 percent to 75 percent a thickness of the hollow cylindrical body.

Each one of the plurality of wiper couplings 60*ab* is connected at a first end 38 of the multi-segment barrel 40.

The first wiper coupling has a wiper body 62 with at least one wiper groove 64 formed on the inner surface of the wiper body The wiper ring 65*a* is inserted in the wiper groove forming a first wiper seal with a first end of the reciprocating plunger assembly. The second wiper coupling is connected between the first two pairs of stationary segments. The second wiper coupling is made of a second wiper body with at least one second wiper groove and at least one second wiper ring, forming a second wiper seal with a second end of the reciprocating plunger assembly.

The embodiments protect the environment by preventing gas from being trapped between the standing valve and traveling valve causing the pump to quit functioning requiring maintenance and potential gas leakage.

The invention saves time and money for clean-up and remediation around an oil well because the segmented barrels allow for portions of a barrel, rather than the entire barrel, to be replaced in the event of sand damage. This will result in much lower pump repair costs The embodiments more effectively prevent sand damage; more specifically the pump prevents sand from getting between the metal surfaces of the plunger and barrel. Preventing sand from getting between these two parts will minimize grooves that can ruin a rod pump.

The embodiments protect the environment by using the sand and wiper couplings to prevent sand damage. Thus, the pumps will last much longer than traditional pumps in harsh pumping environments leading to fewer maintenance shut downs which can expose the environment to oil and gas exposure.

The invention saves energy because the design of pump allows for fluid to always be on top of the standing valve. This design allows for maximum compression and better pump fillage resulting in a more efficient pump.

The following terms are defined herein:

The term "beveled edges" refers to an edge of a structure that is not perpendicular to the faces of the piece.

The term "down hole pump" refers to a reciprocating plunger pump used in oil wells. The cyclical up and down motion of the pumping unit allows for fluid to be pumped to the surface from thousands of feet below ground.

The term "different lengths" refers to variation of the linear measurement from end to end of an object.

The term "hollow cylindrical body" refers to a three-dimensional region bounded by two concentric cylindrical sections and two parallel annular bases perpendicular to the cylinder's axis.

The term "horse head" refers to the generally horsehead-shaped steel piece at the front of the beam of a pumping unit to which the bridle is attached in sucker rod pumping.

The term "inner groove" refers to an area of a hollow cylindrical body where the inner diameter is more than the other parts of the hollow cylindrical body. The wall thickness of the cylinder is less in the inner groove section.

The term "multi-segment barrel" refers to the pump barrel section of a reciprocating rod pump. The barrel is comprised of more than one section that is joined together by a sand coupling.

The term "pump jack" refers to the over-ground drive for a reciprocating piston pump in an oil well.

The term "reciprocating plunger assembly" refers to the internal portion of the rod pump. The reciprocating plunger assembly is an inner cylindrical tube that fits tightly within the outer cylindrical tube (Barrel). The reciprocating plunger assembly moves up in down within the stationary barrel and uses ball and seat valves to lift fluid to the surface.

The term "sand couplings" is a very short piece of pipe with threaded connections at each end to join two segmented barrels. The sand coupling has a groove cut in the center of the coupling with a shoulder separating the groove and the threads. Sand couplings can be in diameters of 1 to 5 inches and lengths of 2 inches to 24 inches.

The term "stationary segments" refers to segments of the barrel that will remain stationary after the pump is seated in the seat nipple upon initial run in.

The term "sucker rod" refers to a steel rod, typically between 25 and 30 feet (7 to 9 meters) in length, and threaded at both ends, used to join together the surface and downhole components of a reciprocating piston pump installed in an oil well.

The term "upper plunger section" a section configured as a collet in the form of a tapered portion that is slotted to form at least two tapered segments, the upper connector section having an externally threaded portion; and further comprising a collet lock nut having a tapered inner bore that is configured to engage the exterior of the collet and having an internally threaded portion that engages the externally threaded portion of the collet. Includes a recessed portion having a recess located below the threaded rod engagement portion provided with one or more pressure equalization ports that communicate between the interior of the recess to the exterior of the plunger adapter.

The term "wiper body" refers to steel or brass body of the coupling that resembles a short piece of pipe. The wiper grooves and wiper rings are contained within, the wiper body.

The term "wiper couplings" refers to a very short piece of pipe with threaded connections at each end to join two segmented barrels. The wiper coupling has two grooves cut in within the body of the coupling with a shoulder separating the grooves and the threads. The grooves hold a wiper ring. Wiper couplings can be in diameters of 1 to 5 inches and lengths of 2 inches to 24 inches.

The term "wiper groove" refers to an area of a hollow cylindrical body where the inner diameter is more than the other parts of the hollow cylindrical body. The wall thickness of the cylinder is less in the inner groove section. There are one or multiple wiper grooves within a wiper coupling.

The term "wiper ring" refers to a ring employed to keep sand from entering the segmented barrels in which the wiper couplings are attached too.

The term "wiper seals" refers to the seal created by the wiper ring engaging the metal surface of the upper plunger.

Figure 2:
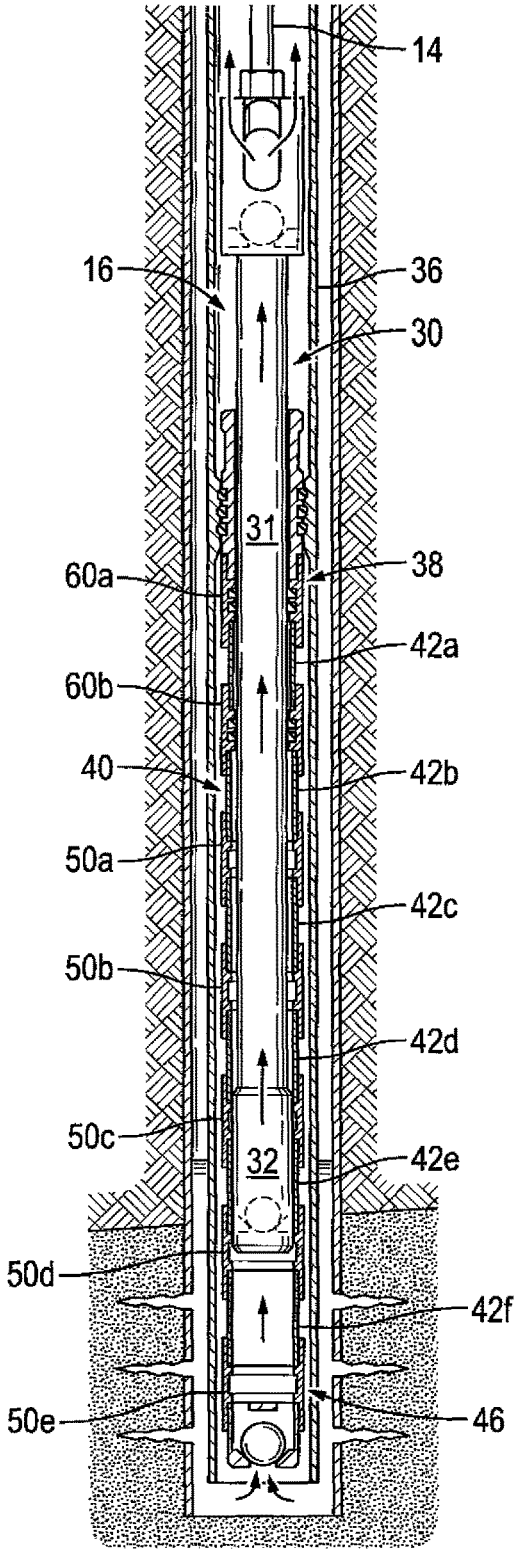
FIG. 2 depicts a detailed view of the downhole pump according to one or more embodiments.

Now turning to the Figures, FIGS. 1 and 2 depict a pump jack and a detailed view of the downhole pump.

The pump jack 10 has a horse head 12.

The horse head is connected to a sucker rod 14, which connects to a downhole pump.

The downhole pump 16 connects to the sucker rod.

The downhole pump in this FIG. 1 is configured with a reciprocating plunger assembly 30 connected to the sucker rod 14.

The reciprocating plunger assembly 30 has an upper plunger section 31 and a lower plunger section 32.

In embodiments, the upper plunger 31 section has a smaller diameter than the lower plunger section 32.

A multi-segment barrel 40 is attached to tubing 36 and slidably engaged to the reciprocating plunger assembly 30.

The multi-segment barrel has a plurality of wiper couplings 60*a* and 60*b*, a plurality of stationary segments 42*a*-42*f*, and a plurality of sand couplings 50*a*-50*e*.

The wiper coupling 60*a* is at a first end 38 of the multi-segment barrel 40.

The wiper coupling 60*b* is located between stationary segment 42*a* and stationary segment 42*b*.

In embodiments, the multi-segment barrel contains the additional stationary segments 42*b*-42*f*, which alternates between stationary segments 42*b*-42*f* and sand couplings 50*a*-50*e*.

For instance, sand coupling 50*a* is between 42*b* and 42*c*; sand coupling 50*b* is between 42*c* and 42*d*; sand coupling 50*c* is between 42*d* and 42*e*; sand coupling 50*d* is between 42*e* and 42; and sand coupling 50*e* is at the second end 46 of the multi-segment barrel.

In embodiments, the plurality of stationary segments is fluidly connected in series.

The multi-segment barrel 40 is shown with six segments. However, the multi-segment barrel 40 can have different variations of segments.

In embodiments, the plurality of stationary segments can be the same lengths or different lengths.

In embodiments the upper plunger section 31 of the reciprocating plunger assembly 30 slidably engages the plurality of wiper couplings 60*a* and 60*b* and the sucker rod 14, and the lower plunger section 32 of the reciprocating plunger assembly 30 slidably engages the upper plunger section 31 and the plurality of sand couplings 50*a*-50*e*.

Figure 3A:
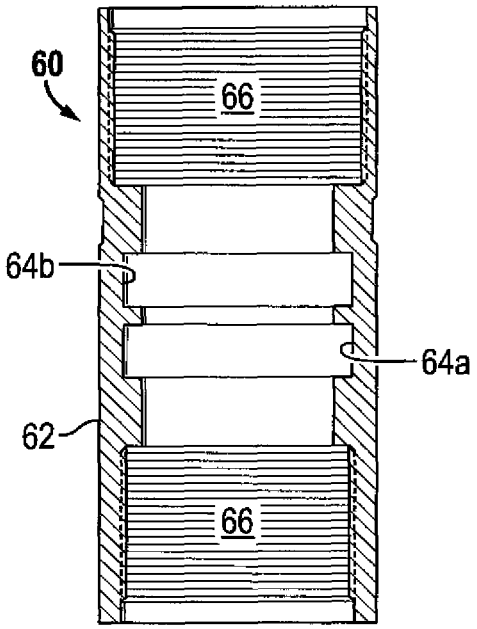
FIGS. 3A and 3B show detail of a wiper coupling according to one or more embodiments.
Figure 3B:
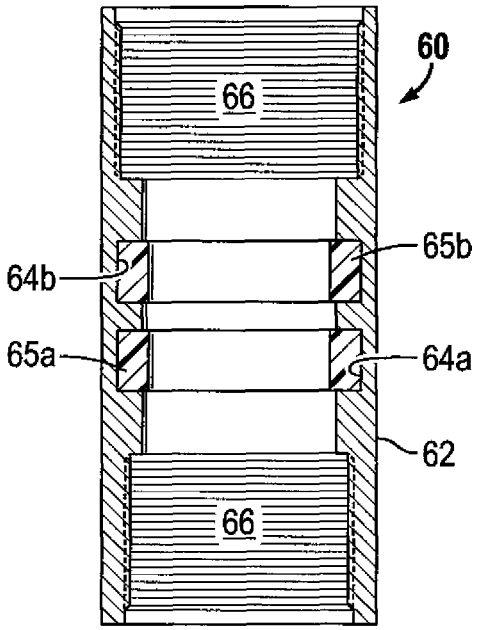

FIGS. 3A and 3B show detail of a wiper coupling 60 according to one or more embodiments.

The wiper coupling 60 contains a wiper body 62 with one or more wiper grooves 64*a*, 64*b* formed on an inner surface of the wiper body.

In embodiments, the wiper coupling 60 may have one or more wiper rings 65*a* and 65*b* inserted in the wiper groove forming a first wiper seal, which engages a first end of the reciprocating plunger assembly.

The wiper coupling includes a pair of make-up shoulders formed in the wiper body and a pair of threads 66. Each thread formed between one of the make-up shoulders and an end of the wiper body.

In embodiments, the wiper ring can be made using a polyamide.

In embodiments, each wiper seal engaging the upper plunger.

The wiper coupling may be with or without the wiper ring.

Figure 4:
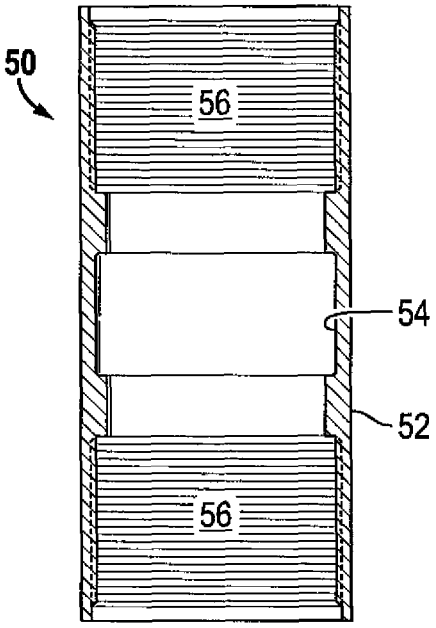
FIG. 4 shows a detail of a sand coupling according to one or more embodiments.

FIG. 4 shows a detail of a sand coupling.

The sand coupling 50 has a hollow cylindrical body 52 with at least one inner groove 54.

The inner groove 54 has a depth from 1 percent to 75 percent a thickness of the hollow cylindrical body.

In embodiments, the inner groove may be a symmetrical groove centrally located in the hollow cylindrical body. The inner groove may have beveled edges.

The sand coupling includes a pair of make-up shoulders formed in the hollow cylindrical body and a pair of threads 56. Each thread formed between one of the make-up shoulders and an end of the hollow cylindrical body.

Example 1

A pump jack 10 for reciprocating a rod string and rod pump in an oil well has a horse head 12. A sucker rod 14 is connected to the horse head.

A downhole pump 16 is connected to the sucker rod. The downhole pump is made of carbon steel. The downhole pump includes a reciprocating plunger assembly 30 connected to the sucker rod 14.

The reciprocating plunger assembly 30 is attached to the tubing 36 slidably engaging a multi-segment barrel 40.

The multi-segment barrel 40 has a plurality of stationary segments 42*a*-42*f*, that are 1¾" diameter and 3 feet in length and are fluidly connected in series. The multi-segment barrel 40 can made from various grades of steel or brass and have a liner made of other harder materials.

The downhole pump contains a plurality of sand couplings 50*ab*, such as are 1 13/16" in diameter and 3 inches long. The sand coupling has a 1" long groove in the center of the coupling and built with carbon steel. Each sand coupling is connected between pairs of stationary segments, which are made with carbon steel with a chrome liner. The stationary segments are 1¾" in diameter and 3 foot in length. Each sand coupling has a hollow cylindrical body 52 diameters of 1 13/16" in diameter and 3 inches long with at least one inner groove 54. The at least one inner groove 54 having a depth of 75 percent of the thickness of the hollow cylindrical body.

A plurality of wiper couplings 60*ab*, with a first wiper coupling connected at a first end 38 of the multi-segment barrel 40, the first wiper coupling having a wiper body 62 with a wiper groove 64 are formed on an inner surface of the wiper body. The wiper couplings are made of various grades of steel or brass.

A wiper ring 65*a* can be inserted in the wiper groove inner groove having a depth of from 75 percent a thickness of the hollow cylindrical body and forms the first wiper seal with a first end of the reciprocating plunger assembly. A second wiper coupling can be connected between the first two pairs of stationary segments. The second wiper coupling includes a second wiper body with a second wiper groove and a second wiper ring forming a second wiper seal with a second end of the reciprocating plunger assembly.

Example 2

A pump jack 10 for lifting a rod string and rod pump in a reciprocating motion has a horse head 12. A sucker rod 14 connected to the horse head.

A downhole pump 16 is connected to the sucker rod. The downhole pump made of 316 Stainless Steel. The downhole pump includes a reciprocating plunger assembly 30 connected to the sucker rod 14.

The reciprocating plunger assembly 30 is attached to the tubing 36 slidably engaging a multi-segment barrel 40.

The multi-segment barrel 40 has a plurality of stationary segments 42*a*-42*f*, that are 1½" diameter and 4 feet in length fluidly connected in series. The multi-segment barrel 40 can made of 316 SS with a Chrome liner.

The downhole pump contains a plurality of sand couplings 50*ab*, such as 1 9/16" in diameter and 4 inches long. The sand coupling has a 2" long groove in the center of the coupling and are made of carbon steel. Each sand coupling is connected between pairs of stationary segments. Each sand coupling has a hollow cylindrical body 52 such as 1½" diameter and 4 feet in length with at least one inner groove 54. The inner groove 54 has a depth of 80 percent of the thickness of the hollow cylindrical body.

A plurality of wiper couplings 60*ab*, with a first wiper coupling connected at a first end 38 of the multi-segment barrel 40, the first wiper coupling has a wiper body 62 with a wiper groove 64 formed on the inner surface of the wiper body. The wiper couplings are made of 316 Stainless Steel.

A wiper ring 65*a* can be inserted in the wiper groove which is a ¾" long by ¼" deep and holds the wiper ring which forms a first wiper seal with a first end of the reciprocating plunger assembly. A second wiper coupling can be connected between the first two pairs of stationary segments. The second wiper coupling includes a second wiper body with a second wiper groove and a second wiper ring forming a second wiper seal with a second end of the reciprocating plunger assembly.

Example 3

A pump jack 10 for lifting a rod string and rod pump in a reciprocating motion and has a horse head 12. A sucker rod 14 is connected to the horse head.

A downhole pump 16 is connected to the sucker rod. The downhole pump is made of brass. The downhole pump includes a reciprocating plunger assembly 30 connected to the sucker rod 14.

The reciprocating plunger assembly 30 is attached to the tubing 36 slidably engaging a multi-segment barrel 40.

The multi-segment barrel 40 has a plurality of stationary segments 42*a*-42*f*, such 1¼" diameter and 5 feet in length fluidly connected in series. The multi-segment barrel 40 can made of brass with a Nicarb liner.

The downhole pump contains a plurality of sand couplings 50*ab*, such as 1 5/16" in diameter and 5 inches long. Each sand coupling is connected between pairs of stationary segments, such as 1¼" diameter and 5 feet in length. Each sand coupling has a hollow cylindrical body 52 that is 1 5/16" in diameter and 5 inches long with at least one inner groove 54. The at least one inner groove 54 has a depth of 85 percent of the thickness of the hollow cylindrical body.

A plurality of wiper couplings 60*ab*, with the first wiper coupling connected at the first end 38 of the multi-segment barrel 40, the first wiper coupling has a wiper body 62 with a wiper groove 64 that is formed on an inner surface of the wiper body. The wiper couplings are made of brass.

A wiper ring 65*a* can be inserted in the wiper groove which is a ¾" long by ¼" deep and holds the wiper ring forming a first wiper seal with a first end of the reciprocating plunger assembly. A second wiper coupling can be connected between the first two pairs of stationary segments. The second wiper coupling includes a second wiper body with a second wiper groove and a second wiper ring forming a second wiper seal with a second end of the reciprocating plunger assembly.

While these embodiments have been described with emphasis on the embodiments, it should be understood that within the scope of the appended claims, the embodiments might be practiced other than as specifically described herein.

What is claimed is:

1. A pump jack comprising:

a. a horse head;

b. a sucker rod connected to the horse head;

c. a downhole pump connected to the sucker rod, the downhole pump comprising:

(i) a reciprocating plunger assembly connected to the sucker rod;

(ii) a multi-segment barrel comprising a plurality of stationary segments fluidly connected in series, wherein the reciprocating plunger assembly attached to a tubing slidably engages the multi-segment barrel;

(iii) a plurality of sand couplings, each sand coupling connected to at least one of the stationary segments of the plurality of stationary segments, each sand coupling of the plurality of sand couplings having a hollow cylindrical body with at least one inner groove, the at least one inner groove having a depth from 1 percent to 75 percent a thickness of the hollow cylindrical body; and (iv) a plurality of wiper couplings, with a first wiper coupling connected at a first end of the multi-segment barrel, the first wiper coupling having a wiper body with at least one wiper groove formed on an inner surface of the wiper body, at least one wiper ring inserted in the at least one wiper groove forming a first wiper seal with a first end of the reciprocating plunger assembly, and a second wiper coupling connected between the first two pairs of stationary segments, the second wiper coupling comprising a second wiper body with at least one second wiper groove and at least one second wiper ring forming a second wiper seal with a second end of the reciprocating plunger assembly.

2. The pump jack of claim 1, wherein the reciprocating plunger assembly comprises: (i) an upper plunger section slidably engages the plurality of wiper couplings and the sucker rod and (ii) a lower plunger section, slidably engages the upper plunger and the plurality of sand couplings.

3. The pump jack of claim 2, wherein the upper plunger section has a smaller diameter than the lower plunger section.

4. The pump jack of claim 1, wherein the wiper ring is a polyamide.

5. The pump jack of claim 1, wherein the plurality of stationary segments have different lengths.

6. The pump jack of claim 1, comprising from 3 to 10 stationary segments connected in series.

7. The pump jack of claim 1, wherein the at least one inner groove is a symmetrical groove centrally located in the hollow cylindrical body.

8. The pump jack of claim 1, wherein the at least one inner groove has beveled edges.

9. The pump jack of claim 1, wherein each sand coupling further comprises: a pair of make up shoulders formed in the hollow cylindrical body and a pair of threads, each thread formed between one of the make up shoulders and an end of the hollow cylindrical body.

10. The pump jack of claim 1, wherein each wiper coupling comprises: a plurality of grooves and a plurality of wiper seals, each wiper seal engaging one of the grooves.

* * * * *